US005330319A

United States Patent [19]

Yu et al.

[11] Patent Number: 5,330,319

[45] Date of Patent: Jul. 19, 1994

[54] AUTOMOTIVE FUEL PUMP VAPOR ORIFICE AND CHANNEL

[75] Inventors: Dequan Yu; Henry W. Brockner, both of Ann Arbor, Mich.

[73] Assignee: Ford Motor Company, Dearborn, Mich.

[21] Appl. No.: 115,079

[22] Filed: Sep. 2, 1993

[51] Int. Cl.[5] ..... F04D 9/00

[52] U.S. Cl. ..... 415/55.1

[58] Field of Search ..... 415/55.1, 55.6, 169.1

[56] References Cited

U.S. PATENT DOCUMENTS

| | | | |
|---|---|---|---|
| 2,006,590 | 7/1935 | Ferguson | 415/55.1 |
| 3,881,839 | 5/1975 | MacManus | 415/55.1 |
| 4,538,958 | 9/1985 | Takei et al. . | |
| 4,793,766 | 12/1988 | Kumata | 415/55.1 |
| 4,844,621 | 7/1989 | Umemura et al. . | |
| 5,009,575 | 4/1991 | Hanai et al. | 415/55.1 |
| 5,024,578 | 6/1991 | Vansadia . | |
| 5,137,418 | 8/1992 | Sieghartner | 415/55.1 |
| 5,141,396 | 8/1992 | Schmidt et al. | 415/55.1 |
| 5,160,249 | 11/1992 | Iwai et al. . | |
| 5,163,810 | 11/1992 | Smith | 415/55.1 |
| 5,192,184 | 3/1993 | Nobuo et al. . | |

*Primary Examiner*—John T. Kwon

*Attorney, Agent, or Firm*—David B. Kelley; Roger L. May

[57] ABSTRACT

A fuel pump of the regenerative turbine type has an impeller enclosed between a pump cover and a pump bottom, with a pumping chamber formed between the cover and bottom along the periphery of the impeller. A vapor purge orifice, having a chamfered inlet, a plurality of different diameter sections, and a chamfered outlet, leads to a vapor purge channel which runs radially along an outside portion of the pump cover. The purge channel has baffles through which the fuel vapor flows before exiting through at least one outlet into the fuel tank. Fuel vapor is more effectively removed from the pumping chamber by the smoother sections and chamfers of the purge orifice and its energy is effectively dissipated by the purge channel baffles, thus reducing pump noise and increasing pump efficiency.

6 Claims, 1 Drawing Sheet

AUTOMOTIVE FUEL PUMP VAPOR ORIFICE AND CHANNEL

FIELD OF THE INVENTION

The present invention relates to electric fuel pumps for automobiles, and, more particularly, to a means for effectively purging fuel vapor from the pumping chamber of a regenerative turbine automotive fuel pump.

BACKGROUND OF THE INVENTION

Regenerative turbine fuel pumps are commonly used to pump fuel to an automotive engine since they have a higher and more constant discharge pressure than, for example, positive displacement pumps. In addition, regenerative turbine pumps typically cost less and generate less noise during operation. A problem develops, however, when the fuel temperature rises and fuel vapor bubbles form within the fuel. Such a result is common because fuel pumps are regularly mounted within a fuel tank where high fuel temperatures result from a variety of reasons, including, for example, hot fuel recirculated from fuel injectors in the engine, rotary motion of the pump impeller, or high ambient air temperatures. If the vapor bubbles thus formed are not removed, the pump flow rate decreases or the pressure drops, resulting in decreased pump efficiency. Fuel vapor also results in pump noise as the pump impeller rotates. If such vapor is not properly vented, annoying venting noises may occur.

A known method of removing the aforementioned fuel vapor bubbles is to provide a vapor purge orifice leading from the pumping chamber surrounding the impeller to the fuel tank, as in U.S. Pat. No. 3,881,839 (MacManus), so that the fuel vapor can bleed back into the fuel tank. Various designs have focused on different factors to optimize vapor venting. For example, placement of a fuel guide recess to direct vapor laden fuel to a purge orifice is disclosed in U.S. Pat. No. 5,160,249 (Iwai et al). In U.S. Pat. No. 5,024,578 (Vansadia), a regenerative fuel pump is vented by a V-shaped passage 84 and an arcuate annular duct 86 that terminate in a restrictor 88. Fuel vapors are vented from a fuel pump in U.S. Pat. No. 4,538,958 (Takei et al) by a passage 6 which communicates with the pump chamber and a housing 7 located over a passage 6. None of these disclosures, however, discuss the shape of the purge orifice.

U.S. Pat. No. 4,844,621 (Umemura et al) and U.S. Pat. No. 5,192,184 (Nobuo et al) show various embodiments of a purge channel and lengths therefore with emphasis on a single outlet. A U-shaped slot is disclosed in U.S. Pat. No. 4,793,766 (Kumata) for separating fuel vapor from liquid fuel in the pumping chamber, but not in the purge channel.

A problem with these prior art disclosures is that consideration is not given to the shape of the purge orifice through which the fuel must flow if it is to be purged at all. In addition, the purge channel of previous pumps has vented only through one vapor outlet thus failing to take advantage of the noise reduction benefits in dual outlet venting and in venting through a baffled channel.

SUMMARY OF THE INVENTION

It is an object of the present invention to improve the vapor purge capability of present automotive regenerative turbine fuel pump designs by furnishing a cover piece for the fuel pump impeller having a vapor purge orifice which provides a smooth transition between the pumping chamber and the vapor purge channel leading to the fuel tank so that less turbulence, and thus less resistance, to the flow is encountered.

A further object of the present invention is to provide a regenerative turbine fuel pump with dual exhaust channels having baffles for improving the vapor purge capability of the pump and for reducing the noise generated by the pump as it pumps fuel to the engine.

These objects are accomplished by providing a fuel pump for supplying fuel from a fuel tank to an automotive engine, with the pump comprising a pump housing, a motor positioned within the housing for rotating a shaft protruding therefrom upon application of an electrical current, and an impeller attached to said shaft for rotatably pumping fuel. A pump bottom, which is mounted to the housing, has an outlet therethrough in fluid communication with a motor chamber surrounding the motor and has an opening for allowing the shaft to pass through to connect to the impeller. A pump cover is mounted on an end of the housing and is attached to the pump bottom with the impeller positioned between the two. A pumping chamber is formed in the housing along the periphery of the impeller. The pump cover has a fuel inlet therethrough in fluid communication with the fuel tank and with the pumping chamber. Means for purging fuel vapor from the pumping chamber are provided, comprising a purge orifice through the pump cover in fluid communication with the pumping chamber and with a purge channel. The purge channel runs radially along an outer circumference of the pump cover and has a plurality of baffles to hinder fuel vapor flow before it exits through at least one vapor outlet leading to the fuel tank. The purge orifice has a plurality of interconnected sections of different diameters for gradually dissipating the vapor flow through the purge orifice. A first chamfered section leads from the pumping chamber to the plurality of sections, and a second chamfered section leads from the sections to the purge channel.

DETAILED DESCRIPTION OF THE PREFERRED EMBODIMENTS

Figure 1:
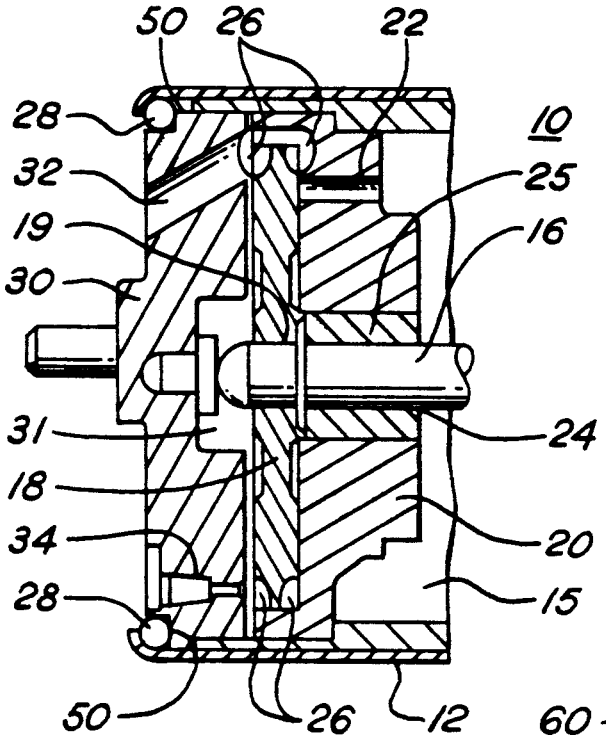
FIG. 1 is a partial cross-sectional view of a pump according to the present invention.

Referring now to FIG. 1, a fuel pump 10 is shown having a pump housing 12 for containing the internal components of pump 10. A motor (not shown), preferably an electric motor, is mounted within pump housing 12 for rotating a shaft 16. An impeller 18 is fixedly attached to shaft 16 and encased within a pump bottom 20 and a pump cover 30. Tapered shoulder 50 receives O-ring 28 so that pump cover 30 fits snugly against pump housing 12. Shaft 16 passes through a shaft opening 24, through an impeller bore 19, and into cover recess 31 of pump cover 30. Bearings 25 are journalled around shaft 16. Pump bottom 20 has a fuel outlet 22 leading from a pumping chamber 26 formed along the periphery of impeller 18 to a motor space 15 surrounding motor (not shown). Pressurized fuel from fuel outlet 32 is forced into motor space 15 where it is routed to a fuel pump outlet (not shown).

Figure 2:
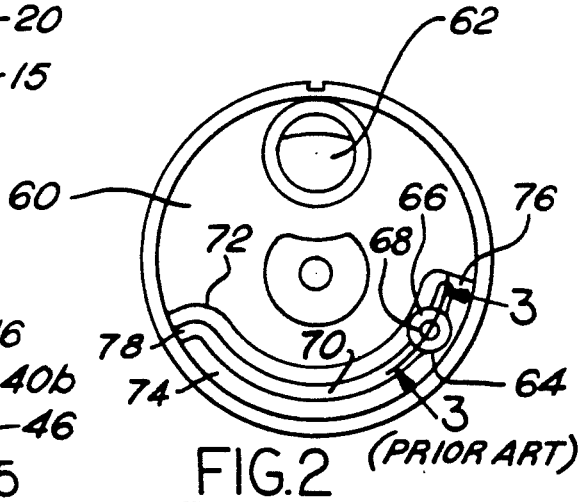
FIG. 2 is a plan view of the outside of a fuel pump cover showing a prior art vapor purge channel.
Figure 3:
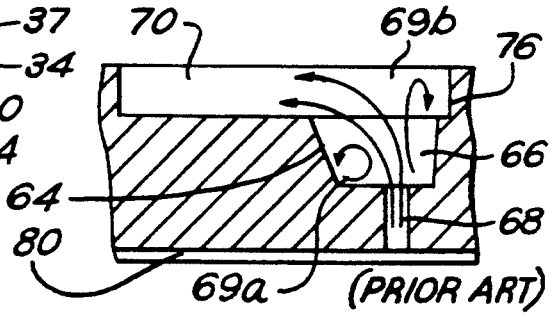
FIG. 3 is a sectional view taken along line 3–3 of FIG. 2 showing the profile of a prior art vapor purge orifice.

Fuel is drawn from a fuel tank (not shown) in which pump 10 is mounted through a fuel inlet 32 in pump cover 30 and into pumping chamber 26 by the rotary pumping action of impeller 18. For previously stated reasons, it is most desirable to eliminate fuel vapor from the fuel being pumped to improve pump efficiency, reduce pump noise, and to prevent vapor from reaching the engine. Thus, as shown in FIGS. 2 and 3 (prior art), a vapor purge orifice 64 has typically been placed through the pump cover 60 to vent such vapor to a vapor purge channel 70 and into the fuel tank (not shown). The prior art purge orifice 64 has sections 66 and 68 for dissipating the fuel vapor flow energy. Section 68 is approximately 1 millimeter in diameter and section 66 approximately 5 millimeters in diameter.

This relatively large variation in section diameters produces a high pressure drop between sections 66 and 68 resulting in large vapor vortices 69*a*. These large vortices 69*a* are essentially turbulence which inhibit fuel vapor flow through the orifice 64 and may cause noise. In addition, the fuel vapor flow must change abruptly between the pumping channel 80 and the purge orifice 64 at section 68 since there are no chamfered sections to allow a smooth transition.

Another drawback of prior art designs is a single purge channel outlet. As shown in FIG. 2, a prior art purge channel 70 has purge channel sides 72 and 74, and channel end 76 which serve to route fuel vapor to vapor outlet 78. However, no baffles are provided to damp noise or decrease flow energy as the vapor passes through the purge channel 70. In addition, only a single vapor outlet 78 leads out of purge channel 70. When the fuel vapor flows from purge orifice section 66 to purge channel 70, it must flow to the left as shown in FIG. 3. Channel end 76 obstructs flow to the right thus causing large vortices 69*b*, which may result in undesirable noise.

Figure 4:
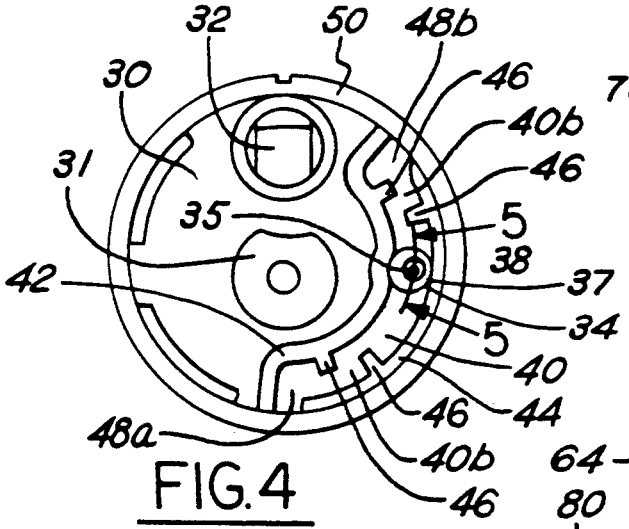
FIG. 4 is a plan view of the outside of a fuel pump cover showing the vapor purge channel of the present invention.
Figure 5:
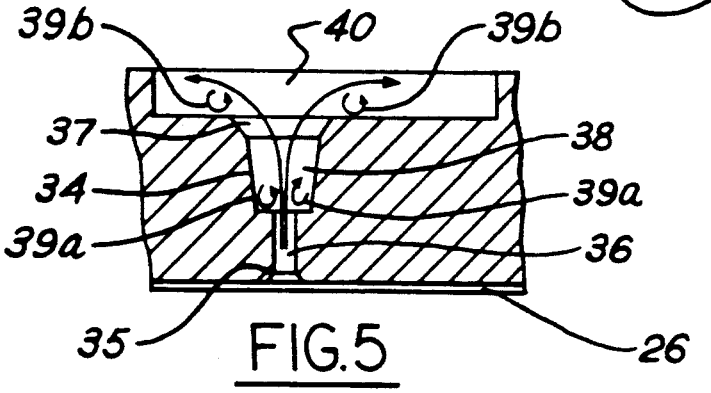
FIG. 5 is a sectional view taken along line 5–5 of FIG. 4 showing the profile of the vapor purge orifice of the present invention.

Pump cover 30 of the present invention has purge orifice 34 and purge channel 40 (FIGS. 4 and 5) designed to overcome the aforementioned disadvantages in prior art fuel pumps. By providing a smoother flow path, the fuel vapor bubbles pass more easily through purge orifice 34 to purge channel 40. Purge orifice 34, with profile as shown in FIG. 5, has multiple small changes in diameter so that smaller vortices 39*a* are formed as the fuel vapor flows through, thus dissipating the vapor flow energy more quietly than the larger vortices 69*a* produced in the prior art designs of FIGS. 2 and 3. Chamfered inlet 35, preferably having an average diameter 0.5 millimeters greater than section 36, provides a smooth transition for the fuel vapor from pumping channel 26 to purge orifice 34, as shown in FIG. 5. Section 36, which preferably has a diameter of approximately 1 millimeter, connects to section 38, which preferably has a diameter of approximately 2 to 3 millimeters. Chamfered outlet 37, which preferably has an average diameter of approximately 1.0 millimeters greater than section 38, for example 3.0 to 4.0 millimeters, connects section 38 to purge channel 40. The components of purge orifice 34, that is, chamfered inlet 35, sections 36 and 38, and chamfered outlet 37, can be machined into pump cover 30 after molding or, preferably, are integrally molded as one piece together with purge channel 40, baffles 46, vapor outlets 48, and fuel inlet 32. Pump cover 30 preferably is made of a rigid plastic, such as acetyl, or can also be made of aluminum.

Purge channel 40 provides baffles 46 and dual vapor outlets 48 to reduce fuel vapor velocity through purge channel 40 by a larger amount than in the single channel prior art designs. As shown in FIG. 4, purge channel 40 has branch 40*a* below purge orifice 34 and branch 40*b* above purge orifice 34. Each branch has two baffles 46, one on channel side 42 and one on channel side 44, opposite one another. As such, when fuel vapor flow exits purge orifice 34, it flows to either branch 40*a* or branch 40*b* thus eliminating the vortices 69*b* produced by configurations such as FIG. 3 and the noise attendant such vortices. Regardless of which branch the fuel vapor flows through, it must encounter baffles 46 before exiting through vapor outlet 48*a* or vapor outlet 48*b*. By dissipating a larger amount of energy within the purge channel 40, noise is reduced since the vapor fuel flow velocity and pressure drop at the dual vapor outlets 48 are less than for prior art designs.

Although the preferred embodiment of the present invention has been disclosed, various changes and modifications may be made without departing from the scope of the invention as set forth in the appended claims.

We claim:

1. A fuel pump for supplying fuel from a fuel tank to an automotive engine, comprising:

a pump housing;

a motor positioned within said housing, said motor able to rotate a shaft protruding therefrom upon application of an electrical current;

an impeller attached to said shaft for rotatably pumping fuel;

a pump bottom mounted to said housing having an outlet therethrough in fluid communication with a motor chamber surrounding said motor, said pump bottom having an opening for allowing said shaft to pass through to connect to said impeller;

a pump cover mounted on an end of said housing and attached to said pump bottom with said impeller therebetween such that a pumping chamber is formed in said housing along the periphery of said impeller, and with said pump cover having a fuel inlet therethrough in fluid communication with said fuel tank and with said pumping chamber; and means for purging fuel vapor from said pumping chamber comprising a purge orifice through said pump cover in fluid communication with said pumping chamber and with a purge channel, said purge channel running radially along an outer circumference of said pump cover and having a plurality of baffles to hinder fuel vapor flow before said fuel vapor exits through at least one vapor outlet leading to said fuel tank, and with said purge orifice having a plurality of interconnected sections of different diameters for gradually dissipating said fuel vapor through said purge orifice, a first chamfered section leading from said pumping chamber to said plurality of interconnected sections, and a second chamfered section leading from said plurality of sections to said purge channel.

2. A fuel pump according to claim 1 wherein said purge orifice has a first section with a diameter of approximately 1 millimeter in communication with said inlet chamfer and a second section in communication with said outlet chamfer having a diameter of approximately 2 to 3 millimeters.

3. A fuel pump according to claim 2 wherein said inlet chamfer has an average diameter of approximately 0.5 millimeters greater than said diameter of said first section and said outlet chamfer has an average diameter of approximately 1.0 millimeters greater than said diameter of said second section.

4. A fuel pump according to claim 1 wherein said purge channel has first and second branches which run in radially opposite directions from said purge orifice, said first and second branches having first and second outlets, respectively, which lead into said fuel tank, and with at least one baffle in said first branch and at least one baffle in said second branch.

5. A fuel pump according to claim 4 wherein said first branch has two baffles interposed on opposite sides of said first branch, and wherein said second branch has two baffles interposed on opposite sides of said second branch.

6. A fuel pump according to claim 5 wherein said pump cover is a single integrally molded piece.

* * * * *